United States Patent [19]

Mayama et al.

[11] Patent Number: 4,836,848

[45] Date of Patent: Jun. 6, 1989

[54] FE-BASED SINTERED ALLOY FOR VALVE SEATS FOR USE IN INTERNAL COMBUSTION ENGINES

[75] Inventors: Osamu Mayama; Yoshimi Ishikawa, both of Niigata, Japan

[73] Assignee: Mitsubishi Kinzoku Kabushiki Kaisha, Tokyo, Japan

[21] Appl. No.: 103,925

[22] Filed: Oct. 2, 1987

[30] Foreign Application Priority Data

Mar. 12, 1987 [JP] Japan ..... 62-57626

[51] Int. Cl.[4] ..... C22C 38/08

[52] U.S. Cl. ..... 75/231; 75/237; 75/241

[58] Field of Search ..... 75/231, 237, 238, 241

[56] References Cited

U.S. PATENT DOCUMENTS

| | | |
|---|---|---|
| 3,479,289 | 11/1969 | Van Wyk . |
| 3,880,600 | 4/1975 | Zboril . |
| 4,204,031 | 5/1980 | Takemura et al. . |
| 4,345,943 | 8/1982 | Takahashi et al. . |
| 4,348,232 | 9/1982 | Hiraoka et al. . |
| 4,546,737 | 10/1985 | Kazuoka et al. . |
| 4,599,110 | 7/1986 | Kohler et al. . |
| 4,614,544 | 9/1986 | Lall . |

FOREIGN PATENT DOCUMENTS 1114704 9/1984 U.S.S.R. ..... 75/231

OTHER PUBLICATIONS

Henderson et al., "*Metallurgical Dictionary*", 1953, p. 79.

*Primary Examiner*—Stephen J. Lechert, Jr.
*Assistant Examiner*—Eric Jorgensen
*Attorney, Agent, or Firm*—Frishauf, Holtz, Goodman & Woodward

[57] ABSTRACT

An Fe-base sintered alloy for valve seats for use in internal combustion engines and a method of manufacturing the same are provided. The alloy consists essentially of 0.6 to 1.3% C, 1 to 5% Cr, 4 to 15% Mo, 0.5 to 2% Ni, 2 to 8% Co, 0.2 to 2% Nb, 0.2 to 2% at least one lubricating component selected from the group consisting of a $CaF_2$ and $BaF_2$ and the balance of Fe and inevitable impurities. Starting powders are blended into the same composition as above, and mixed into a mixed powder. The mixed powder is pressed into a green compact. Then, the green compact is presintered, hot forged, sintered, and, if required, further heat treated, in sequence to be formed into an Fe-base sintered alloy having a structure wherein particles of the at least one lubricating component and hard particles of other components are dispersed in a matrix formed principally of a pearlite phase. The resulting alloy possesses a density of at least 7.3 g/cm$^3$ and Rockwell handness of 30–50 in Rockwell Scale C, and hence exhibits excellent abrasion resistance as well as excellent lubricity.

7 Claims, No Drawings

FE-BASED SINTERED ALLOY FOR VALVE SEATS FOR USE IN INTERNAL COMBUSTION ENGINES

BACKGROUND OF THE INVENTION

This invention relates to Fe-base sintered alloys for valve seats for use in internal combustion engines in which light oil, LPG, or the like is used as a fuel, and a method of manufacturing same, and more particularly to Fe-base sintered alloys of this kind which possess high strength and high hardness and hence exhibit excellent abrasion resistance as well as excellent lubricity, and a method of manufacturing same.

Conventionally, various kinds of Fe-base sintered alloys have widely been used for the production of valve seats for use in internal combustion engines. However, these conventional Fe-base sintered alloys have too low density and are hence too porous to provide a valve seat formed thereof with satisfactory strength. To provide sufficient strength for valve seats formed of the conventional Fe-base sintered alloys, usually Cu, Pb, or the like are infiltrated into the surfaces of the valve seats so as to seal the pores with the Cu, Pb or the like. However, even if such sealing is applied to the valve seats, the conventional sintered alloys themselves have hardness insufficient for use as the valve seats and are liable to get abraded particularly when a fuel with low lubricity is used in the engines.

The tendency of abrasion of the alloys has become more conspicuous as internal combustion engines with higher performance have been developed and operated under more severe operating conditions.

SUMMARY OF THE INVENTION

It is an object of the invention to provide Fe-base sintered alloys for valve seats for use in internal combustion engines, which possess high strength and high hardness and hence exhibit excellent abrasion resistance as well as excellent lubricity.

It is another object of the invention to provide a method of manufacturing Fe-base sintered alloys for valve seats for use in internal combustion engines, which are excellent in abrasion resistance as well as in lubricity.

The present invention provides an Fe-base sintered alloy for valve seats for use in internal combustion engines, consisting essentially of: 0.6 to 1.3% C; 1 to 5% Cr; 4 to 15% Mo; 0.5 to 2% Ni; 2 to 8% Co; 0.2 to 2% Nb; 0.2 to 2% at least one lubricating component selected from the group consisting of $CaF_2$ and $BaF_2$; and the balance of Fe and inevitable impurities. The Fe-base sintered alloy has a structure wherein particles of the at least one lubricating component and hard particles of other components are dispersed in a matrix formed principally of a pearlite phase, and the alloy possesses a density of at least 7.3 g/cm$^3$ and Rockwell hardness of 30–50 in Rockwell Scale C.

(The percentages are in weight percent throughout the specification, unless otherwise specified.)

The present invention further provides a method of manufacturing an Fe-base sintered alloy for valve seats for use in internal combustion engines, comprising the following steps:

(a) blending starting powders in a blending ratio of 0.6 to 1.3% C, 1 to 5% Cr, 4 to 15% Mo, 0.5 to 2% Ni, 2 to 8% Co, 0.2 to 2% Nb, 0.2 to 2% at least one lubricating component selected from the group consisting of $CaF_2$ and $BaF_2$ and the balance of Fe and inevitable impurities, and mixing the blended starting powders into a mixed powder;

(b) applying pressure to the mixed powder to form a green compact;

(c) presintering the green compact in one of a vacuum atmosphere and a reducing gas atmosphere at a temperature within a range from 900° to 1180° C. to form a presintered body;

(d) hot-forging the presintered body at a temperature within a range from 950° to 1100° C. to form a forged body; and (e) sintering the forged body in one of a vacuum atmosphere and a reducing gas atmosphere at a temperature within a range from 1000° to 1180° C. to form a sintered body.

If required, the sintered body may be subjected to heat treatment at a temperature within a range from 600° to 800° C.

DETAILED DESCRIPTION

Under the aforestated circumstances, the present inventors have made many studies in order to obtain an Fe-base sintered alloy having high strength and high hardness and hence being excellent in abrasion resistance as well as in lubricity. As a result, the inventors have reached the following findings:

(a) If a presintered body having a chemical composition of 0.6 to 1.3% C; 1 to 5% Cr; 4 to 15% Mo; 0.5 to 2% Ni; 2 to 8% Co; 0.2 to 2% Nb; 0.2 to 2% at least one lubricating component selected from the group consisting of $CaF_2$ and $BaF_2$; and the balance of Fe and inevitable impurities, is hot-forged; the resulting forged body can have a high density, i.e., 7.3 g/cm$^3$ or more, and hence high strength.

(b) Further, if the forged body with such a high density is sintered, and if required, thereafter subjected to heat treatment so that the resulting Fe-base sintered alloy has a structure wherein particles of the lubricating component(s) and hard particles of such components as Mo, Fe-Mo, and carbides are dispersed in a matrix formed principally of a pearlite phase, preferably a structure wherein the alloy consists essentially of:

2 to 20 volume % a disperse phase formed of the lubricating component(s) and the hard particles;

50 to 90 volume % a pearlite phase, 1 to 20 volume % a martensite phase, not more than 5 volume % an austenite phase, and the balance of a ferrite phase, all the above phases forming the matrix, the resulting Fe-base sintered alloy possesses high Rockwell hardness of 30–50 in Rockwell Scale C.

Therefore, if the resulting Fe-base sintered alloy is used as a valve seat for use in internal combustion engines, the valve seat exhibits excellent abrasion resistance as well as excellent lubricity even when a fuel having poor lubricity such as clear gasoline, propane, light oil is used in the engine, thereby enduring a long-term use with reliableness.

The present invention is based upon the above findings and provides an Fe-base sintered alloy for valve seats for use in internal combustion engines having the above-stated chemical composition and properties.

In the Fe-base sintered alloy and the method of manufacturing the same according to the present invention, the composition and properties of the alloy, and the conditions for manufacturing the same have been limited in the previously stated manner for the following reasons:

(a) C ( Carbon):

The element C combines with other ingredients of the alloy to form carbides and further acts in cooperation with the Fe and other ingredients to form a matrix formed principally of a pearlite phase, thereby contributing to increasing the abrasion resistance and strength of the resulting alloy. However, if the C content is below 0.6%, the above action cannot be performed to a required extent. On the other hand, if C is contained in excess of 1.3% in the alloy, it will result in increased wear of a valve against which the valve seat is seated. Therefore, the C content has been limited to a range from 0.6 to 1.3%. Best results can be obtained if the C content falls within a range from 0.9 to 1.1.

(b) Cr (Chromium):

The element Cr is dissolved in the matrix of the alloy to enhance the heat resistance, and further combines with C present in the alloy to form carbide, thereby improving the abrasion resistance of the resulting alloy. However, if the Cr content is below 1%, the above action cannot be performed to a required extent. On the other hand, if Cr is contained in excess of 5% in the alloy, it will result in degraded sinterability of the alloy, making it difficult to obtain an alloy with high density and hence high strength. Therefore, the Cr content has been limited to a range from 1 to 5%. Best results can be obtained if the Cr content falls within a range from 2 to 3.

(c) Mo (Molybdenum):

The element Mo is dissolved in the form of Mo particles or Fe-Mo particles in the matrix of the alloy, and acts to improve the abrasion resistance of the alloy. However, if the Mo content is below 4%, the abrasion resistance canot be improved to a required degree. On the other hand, if Mo is contained in excess of 15% in the alloy, the resulting alloy has degraded strength, thus making it difficult to use the valve seat formed of the resulting alloy under a heavy load condition. Therefore, the Mo content has been limited to a range from 4 to 15%. Best results can be obtained if the Mo content falls within a range from 5 to 8.

(d) Ni (Nickel):

The element Ni is dissolved in the matrix of the alloy to strengthen the same. However, if the Ni content is below 0.5%, the matrix cannot be strengthened to a required level. On the other hand, even if contained in excess of 2% in the alloy, the Ni can hardly increase the strength of the resulting alloy. Therefore, the Ni content has been limited to a range from 0.5 to 2% from the viewpoint of economy. Best results can be obtained if the Ni content falls within a range from 0.5 to 1.5.

(e) Co (Cobalt):

The element Co, like Ni, is dissolved in the matrix of the alloy to strengthen the same. However, if the Co content is below 2%, the above action cannot be performed to a required extent. On the other hand, even if contained in excess of 8% in the alloy, the Co can hardly increase the strength of the resulting alloy. Therefore, the Co content has been limited to a range from 2 to 8% from the viewpoint of economy. The preferable Co content should be from 3 to 5.

(f) Nb (Niobium):

The element Nb combines with C present in the alloy to form carbide, thus improving the abrasion resistance of the resulting alloy. However, if Nb is contained in less than 0.2%, the above action cannot be performed to a required extent. On the other hand, even if contained in excess of 2% in the alloy, the Nb can hardly improve the abrasion resistance of the resulting alloy. Therefore, the Nb content has been limited to a range from 0.2 to 2%. Best results can be obtained if the Nb content falls within a range from 0.7 to 1.3.

(g) Lubricating Component(s)

One or more lubricating components of $CaF_2$ and $BaF_2$ BN, $MoS_2$, and $WS_2$ are dispersed in the matrix of the alloy, thereby improving the lubricity of the resulting alloy. However, if the lubricating component content is below 0.2%, required lubricity cannot be obtained. On the other hand, if lubricating component(s) is contained in excess of 2% in the alloy, it can spoil the strength of the resulting alloy. Therefore, the lubricating component content has been limited to a range from 0.2 to 2%. A preferable range of the lubricating component contained should be from 0.7 to 1.2.

(h) Density:

If the density of the alloy is below 7.3g/cm$^3$, there can be formed a considerable number of pores in the alloy, which makes it difficult to obtain a sintered alloy with desired strength. Therefore, it is required for the presintered body to be hot worked or hot forged so as to have a density of 7.3 g/cm$_3$ or more.

(i) Hot-Forging Temperature:

Further, to ensure that the sintered alloy has a density of 7.3 g/cm$^3$ or more the hot working or hot forging of the presintered body should be carried out at a temperature within a range from 950° to 1100° C., and preferably from 1000° to 1100° C.

If the temperature is below 950° C. there occurs cracking or fracture of the alloy during hot working of the same, while if the temperature is above 1100° C., there occurs grain growth in the alloy or oxidation of the alloy.

(j) Hardness:

If the hardness of the sintered alloy is below hardness C30, the abrasion resistance of a valve seat formed thereof is unsatisfactorily low. On the other hand, if the hardness is in excess of Rockwell Hardness C50, the resulting alloy has low machinability, thereby increasing the machining cost. Therefore, the Rockness hardness (C scale) has been limited to a range from 30 to 50, and preferably from 35 to 45.

(k) Volume Percentage of Pearlite Phase:

If the percentage of the pearlite phase in the matrix is less than 50 volume %, the Rockwell hardness will be less than the lower limit of 30, while if it exceeds 90 volume %, the Rockwell hardness will be higher than 50. Therefore, the pearlite phase percentage has been limited within a range from 50 to 90 volume %.

(l) Other Temperature Conditions:

In manufacturing an Fe-base sintered alloy according to the invention, the green compact should preferably be presintered in vacuum or in a reducing gas atmosphere at a temperature within a range from 900° to 1180° C. for a predetermined period of time, preferably one hour. If the presintering is performed at a temperature below 900° C., the starting powders are not fully fused together into a presintered body, while if the temperature is above 1180° C., there occurs grain growth in the alloy or oxidation of the alloy. The forged body should preferably be sintered in vacuum or in a reducing gas atmosphere at a temperature within a range from 1000° to 1180° C. for a predetermined period of time, preferably one hour. If the sintering temperature is below 1000° C., the forged body is insufficiently sintered, while if the sintering temperature is above 1180° C., there can occur grain growth in the alloy or oxidation of the alloy. Further, if required, the sintered body should be heat treated at a temperature within a range from 600° to 800° C. and thereafter cooled at an appropriate cooling rate in order to form an alloy structure formed principally of a pearlite phase.

EXAMPLE

An example of the Fe-base sintered alloy and the method according to the present invention will be given hereinbelow.

The following starting powders were prepared: powder of atomized Fe, powder of carbonyl Ni, powder of Co, powder of Fe-Cr alloy contraining 60 % Cr, powder of Fe-Nb alloy containing 60% Nb, and powder of atomized Fe-Cr-Nb alloy containing 13% Cr and 5% Nb, each having a grain size of 100 mesh or less; powder of natural graphite, powder of Fe-Mo alloy containing 60% Mo, powder of $CaF_2$, powder of $BaF_2$, powder of BN, powder of $MoS_2$, and powder of $WS_2$, each having a grain size of 150 mesh or less; and powder of Mo having a grain size of 200 mesh or less. These starting powders were blended into compositions shown in Table, and were mixed into mixed powders. Each of the mixed powders was pressed at a pressure of 6 ton/cm2 into green compacts. Each green compact was heated at a temperature of 500° C. for 30 minutes to be dewaxed, and thereafter presintered in an ammonolysis gas atmosphere at a temperature of 1120° C. for 1 hour. The presintered bodies thus obtained were each hot forged at a temperature of 1000° C., followed by sintering the forged bodies in an ammonolysis gas atmosphere at a temperature of 1150° C. for 1 hour into sintered bodies. The sintered bodies were finally heat-treated at a predetermined temperature within a range from 640° to 690° C. for 90 minutes, respectively, thus being formed into valve seats Nos. 1–15 formed of Fe-base sintered alloys according to the present invention (hereinafter called "the valve seats according to the present invention") and valve seats Nos. 1–10 formed of comparative Fe-base sintered alloys (hereinafter called "the comparative valve seats"). The valve seats Nos. 1–15 according to the present invention and the comparative valve seats Nos. 1–10 have substantially the same chemical compositions as the respective blending compositions of the starting powders thereof, and each have a size of 48mm in outer diameter, 40mm in inner diameter, and 8mm in thickness.

Incidentally, the comparative valve seats Nos. 1–10 each have at least one, asterisked in Table, of its components contained in an amount falling outside the range of the present invention.

Then, the valve seats Nos. 1–15 according to the present invention and the comparative valve seats Nos. 1–10 were each measured in density for evaluation of the strength as well as in Rockwell hardness (HRC) for evaluation of the abrasion resistance, and also the proportion of the area occupied by the pearlite phase of the alloy structure was measured by observing a section of the valve seat by the use of a microscope.

Further, the valve seats No. 1–15 according to the present invention and the comparative valve seats Nos. 1–10 were subjected to abrasion test by the use of a tester under the following conditions:

Material of Valve As A Mate with Valve Seat: SUH-3;

Heating Temperature for Valve: 900° C.;

Rate of Opening and Closing for Valve: 2500 times per minute;

Atmosphere: a gas produced through combustion of a propane gas under a pressure of 0.4 kg/cm2 and an oxygen gas flowing at a flow rate of 1.5 1/min;

Heating Temperature for Valve Seat (seat holder was water - cooled): 250° -300° C., Seating Load: 30kg, and Testing Time: 100 hours.

In the above abrasion test, the maximum depth of abrasion of each valve seat was measured to evaluate the abrasion resistance of the valve seat, while the maximum depth of abrasion of each valve was measured to evaluate the lubricity of the valve seat. The results of the measurements are shown in Table.

TABLE (1/2)

| | BLENDING RATIO OF STARTING POWDERS (IN WEIGHT %) | | | | | | | | | | | |
|---|---|---|---|---|---|---|---|---|---|---|---|---|
| | C | Cr | Mo | Ni | Co | Nb | LUBRICATING COMPONENT(S) | INEVITABLE IMPURITIES | DENSITY (g/cm³) | HARDNESS ($H_RC$) | PROPORTION OF AREA OCCUPIED BY PEARLITE PHASE (%) | MAXIMUM DEPTH OF ABRASION OF VALVE SEAT (μm) | MAXIMUM DEPTH OF ABRASION OF VALVE (μm) |
| VALVE SEATS ACCORDING TO THE PRESENT INVENTION | | | | | | | | | | | | | |
| 1 | 0.6 | 2.5 | 6.5 | 1 | 4 | 1 | $B_aF_2$:1 | THE BAL. | 7.40 | 43 | 50 | 40 | 10 |
| 2 | .1 | 2.5 | 6.5 | 1 | 4 | 1 | $MoS_2$:1 | " | 7.40 | 45 | 70 | 45 | 10 |
| 3 | 1.3 | 2.5 | 6.5 | 1 | 4 | 1 | $MoS_2$:0.25 | " | 7.35 | 47 | 90 | 55 | 15 |
| 4 | 1 | 1 | 6.5 | 1 | 4 | 1 | BN:0.5 | " | 7.40 | 35 | 70 | 60 | 10 |
| 5 | 1 | 5 | 6.5 | 1 | 4 | 1 | $CaF_2$:0.5 | " | 7.35 | 32 | 50 | 55 | 20 |
| 6 | 1 | 2.5 | 4 | 1 | 4 | 1 | $WS_2$:1.5 | " | 7.35 | 40 | 70 | 35 | 5 |
| 7 | 1 | 2.5 | 15 | 1 | 4 | 1 | $BaF_2$:0.5 $CaF_2$:0.5 | " | 7.30 | 40 | 50 | 30 | 15 |
| 8 | 1 | 2.5 | 6.5 | 0.5 | 4 | 1 | $CaF_2$:2 | " | 7.40 | 42 | 70 | 35 | 5 |
| 9 | 1 | 2.5 | 6.5 | 2 | 4 | 1 | BN:0.5, $WS_2$:0.5 | " | 7.40 | 40 | 50 | 45 | 10 |
| 10 | 1 | 2.5 | 6.5 | 1 | 2 | 1 | BN:1 | " | 7.35 | 43 | 70 | 50 | 10 |
| 11 | 1 | 2.5 | 6.5 | 1 | 8 | 1 | $BaF_2$:2 | " | 7.40 | 40 | 50 | 35 | 5 |
| 12 | 1 | 2.5 | 6.5 | 1 | 4 | 0.2 | $BaF_2$:0.5, BN: 0.5, $WS_2$:0.5 | " | 7.40 | 37 | 70 | 45 | 5 |
| 13 | 1 | 2.5 | 6.5 | 1 | 4 | 2 | $MoS_2$:0.3 | " | 7.40 | 40 | 70 | 55 | 15 |
| 14 | 1 | 2.5 | 6.5 | 1 | 4 | 1 | $WS_2$:0.2 | " | 7.40 | 42 | 70 | 35 | 5 |
| 15 | 1 | 2.5 | 6.5 | 1 | 4 | 1 | $CaF_2$:1, BN:0.6 $MoS_2$:0.3 | " | 7.40 | 40 | 70 | 40 | 5 |

TABLE (2/2)

| | BLENDING RATIO OF STARTING POWDERS (IN WEIGHT %) | | | | | | | | | | | |
|---|---|---|---|---|---|---|---|---|---|---|---|---|
| | C | Cr | Mo | Ni | Co | Nb | LUBRICATING COMPONENT(S) | INEVITABLE IMPURITIES | DENSITY (g/cm³) | HARDNESS ($H_RC$) | PROPORTION OF AREA OCCUPIED BY PEARLITE PHASE (%) | MAXIMUM DEPTH OF ABRASION OF VALVE SEAT (μm) | MAXIMUM DEPTH OF ABRASION OF VALVE (μm) |
| COMPARATIVE VALVE SEATS | | | | | | | | | | | | | |
| 1 | 0.5* | 2.5 | 6.5 | 1 | 4 | 1 | $CaF_2$:1 | THE BAL. | 7.40 | 27 | 40 | 80 | 10 |
| 2 | 1.5* | 2.5 | 6.5 | 1 | 4 | 1 | $CaF_2$:1 | " | 7.35 | 47 | 90 | 90 | 40 |
| 3 | 1 | 0.7* | 6.5 | 1 | 4 | 1 | $CaF_2$:1 | " | 7.40 | 40 | 80 | 100 | 15 |
| 4 | 1 | 6* | 6.5 | 1 | 4 | 1 | $CaF_2$:1 | " | 7.25 | 45 | 50 | 110 | 25 |
| 5 | 1 | 2.5 | 3* | 1 | 4 | 1 | $CaF_2$:1 | " | 7.35 | 37 | 70 | 100 | 20 |
| 6 | 1 | 2.5 | 16* | 1 | 4 | 1 | $CaF_2$:1 | " | 7.25 | 48 | 30 | 60 | 60 |
| 7 | 1 | 2.5 | 6.5 | 0.1* | 4 | 1 | $CaF_2$:1 | " | 7.40 | 40 | 80 | 80 | 10 |
| 8 | 1 | 2.5 | 6.5 | 1 | 1* | 1 | $CaF_2$:1 | " | 7.40 | 38 | 70 | 80 | 15 |
| 9 | 1 | 2.5 | 6.5 | 1 | 4 | 1 | —* | " | 7.40 | 42 | 70 | 60 | 60 |
| 10 | 1 | 2.5 | 6.5 | 1 | 4 | 1 | $MoS_2$:2.5* | " | 7.40 | 28 | 70 | 90 | 10 |

THE COMPONENT MARKED WITH AN ASTERISK FALLS OUT OF THE RANGE OF THE PRESENT INVENTION.

It will be learned from Table that the valve seats Nos. 1–15 according to the present invention each possess high density or high strength as well as high hardness and hence, as apparent from the abrasion test results of the same table, each exhibit excellent abrasion resistance (35 to 60 μm) as well as excellent lubricity, i.e., the corresponding valves were less abraded (5 to 20 μm).

On the other hand, the comparative valve seats Nos. 1–10, in which at least one of the components has its content falling out of the range of the present invention or the proportion of the area occupied by the pearlite phase is low, are inferior to the above valve seats Nos. 1–15 according to the present invention in respect of the abrasion resistance and/or lubricity, i.e., the maximum depth of abrasion of the valves corresponding to the respective valve seats.

What is claimed is:

1. An Fe-base sintered alloy for valve seats for use in internal combustion engines, consisting essentially of the following components: 0.6 to 1.3% C; 1 to 5% Cr; 4 to 15% Mo; 0.5 to 2% Ni; 2 to 8% Co; 0.2 to 2% Nb; 0.2 to 2% at least one lubricating component selected from the group consisting of $CaF_2$ and $BaF_2$; and the balance of Fe and inevitable impurities; said Fe-base sintered alloy having a structure wherein (i) particles of said at least one lubricating component and (ii) hard particles formed of other of said components, are dispersed in a matrix comprising 50 to 90 volume % of a pearlite phase, and said alloy possessing a density of at least 7.3 g/cm³ and Rockwell hardness of 30–50 in Scale C.

2. A valve seat for use in internal combustion engines comprising the Fe-base sintered alloy of claim 1.

3. The valve seat as claimed in claim 2 wherein said alloy consists essentially of 0.9 to 1.1% C; 2 to 3% Cr; 5 to 8% Mo; 0.5 to 1.5% Ni; 3 to 5% Co; 0.7 to 1.2% Nb and 0.7 to 1.3% of said at least one lubricating components; said alloy having a Rockwell hardness of 35–45 on the C scale.

4. The valve seat according to claim 3 wherein said matrix of said alloy contains at least 50 volume % said pearlite phase; and wherein said alloy consists essentially of: 2 to 20 volume % a disperse phase formed of said at least one lubricating component and said hard particles; 50 to 90 volume % said pearlite phase, 1 to 20 volume % a martensite phase, 5 volume % or less an austenite phase, and the balance of a ferrite phase, all said phases forming said matrix.

5. An Fe-base sintered alloy as claimed in claim 1, wherein said alloy consists essentially of: 2 to 20 volume % a disperse phase formed of said at least one lubricating component and said hard particles; 50 to 90 volume % said pearlite phase, 1 to 20 volume % a martensite phase, 5 volume % or less an austenite phase, and the balance of a ferrite phase, all said phases forming said matrix.

6. An Fe-base sintered alloy as claimed in claim 5, wherein said alloy consists essentially of 0.9 to 1.1%C; 2 to 3% Cr; 5 to 8% Mo; 0.5 to 1.5% Ni; 3 to 5% Co; 0.7 to 1.3% Nb and 0.7 to 1.2% of said at least one lubricating components; said alloy having a Rockwell hardness of 35–45 on the C scale.

7. An Fe-base sintered alloy as claimed in claim 1, wherein said alloy consists essentially of 0.9 to 1.1% C; 2 to 3% Cr; 5 to 8% Mo; 0.5 to 1.5% Ni; 3 to 5% Co; 0.7 to 1.3% Nb and 0.7 to 1.2% of said at least one lubricating components; said alloy having a Rockwell hardness of 35–45 on the C scale.

* * * * *